US011980798B2

(12) United States Patent
Bandecchi

(10) Patent No.: US 11,980,798 B2
(45) Date of Patent: May 14, 2024

(54) HYDROFOIL SIMULATOR STRUCTURE

(71) Applicant: HYDROFOIL SIMULATOR S.R.L., Leghorn (IT)

(72) Inventor: Nicola Bandecchi, Leghorn (IT)

( * ) Notice: Subject to any disclaimer, the term of this patent is extended or adjusted under 35 U.S.C. 154(b) by 0 days.

(21) Appl. No.: 18/551,406

(22) PCT Filed: Apr. 5, 2022

(86) PCT No.: PCT/IB2022/053163

§ 371 (c)(1),
(2) Date: Sep. 20, 2023

(87) PCT Pub. No.: WO2022/229747

PCT Pub. Date: Nov. 3, 2022

(65) Prior Publication Data

US 2024/0082676 A1 Mar. 14, 2024

(30) Foreign Application Priority Data

Apr. 27, 2021 (IT) ..... 102021000010598

(51) Int. Cl.

| | |
|---|---|
| ***A63B 69/00*** | (2006.01) |
| ***A63B 69/12*** | (2006.01) |
| ***A63B 71/00*** | (2006.01) |
| ***A63B 71/02*** | (2006.01) |
| *B63B 34/40* | (2020.01) |

(52) U.S. Cl.

CPC ..... *A63B 69/0093* (2013.01); *A63B 69/125* (2013.01); *A63B 71/0054* (2013.01); *A63B 71/021* (2013.01); *B63B 34/40* (2020.02)

(58) Field of Classification Search

CPC ... A63B 69/03; A63B 69/125; A63B 71/0054; A63B 71/021; B63B 34/40

See application file for complete search history.

(56) References Cited

U.S. PATENT DOCUMENTS

| | | | | |
|---|---|---|---|---|
| 4,813,366 | A * | 3/1989 | Elder | B63B 34/05 114/39.26 |
| 6,336,771 | B1 * | 1/2002 | Hill | A63G 31/007 4/491 |
| 8,944,872 | B2 * | 2/2015 | Hill | B63B 32/66 441/74 |
| 9,056,654 | B1 * | 6/2015 | Fraser | B63B 32/60 |
| 9,669,902 | B2 * | 6/2017 | Geislinger | B63B 1/242 |
| 10,940,917 | B2 * | 3/2021 | Montague | B63B 32/57 |
| 10,946,939 | B1 * | 3/2021 | Montague | B63B 32/66 |
| 11,235,219 | B2 * | 2/2022 | Perez | E04H 4/0006 |

(Continued)

FOREIGN PATENT DOCUMENTS

| | | |
|---|---|---|
| DE | 10 2015 104199 A1 | 9/2016 |
| WO | 2007/070915 A1 | 6/2007 |

OTHER PUBLICATIONS

ISR; European Patent Office; dated Jun. 24, 2022.

*Primary Examiner* — Joshua Lee

(74) *Attorney, Agent, or Firm* — Patshegen IP; Moshe Pinchas

(57) ABSTRACT

A hydrofoil simulator structure comprising a tank, in which a water current is generated, and a frame, which supports an elastic trampoline positioned above the water surface of the tank; the structure also comprising a series of elastic ropes associated with a trapeze harness worn by a user who stands on a board of a hydrofoil having wings immersed in water.

8 Claims, 5 Drawing Sheets

(56) References Cited

U.S. PATENT DOCUMENTS

| | | | | |
|---|---|---|---|---|
| 11,485,457 | B1 * | 11/2022 | Montague | B63B 34/10 |
| 11,766,598 | B1 * | 9/2023 | Jungclaussen | A63B 71/0054 482/51 |
| 2005/0017463 | A1 | 1/2005 | Kane | |
| 2005/0255764 | A1 | 11/2005 | Woolley | |
| 2011/0143846 | A1 | 6/2011 | Davis | |
| 2021/0268355 | A1 * | 9/2021 | Perez | B63B 21/26 |

* cited by examiner

HYDROFOIL SIMULATOR STRUCTURE

BACKGROUND OF THE INVENTION

The present invention relates to a hydrofoil simulator structure.

The so-called hydrofoils are boards connected to two wings by a bar called a mast.

Hydrofoils can be used by anybody, with any level of coordination, however they constitute a sporting activity that is not without risks due to the large dimension of the two connected wings.

The wings, which create the lifting effect typical of a hydrofoil, are in fact two large blades which, in the case of an unfortunate and disastrous fall by the athlete, can hit delicate body parts.

The need is therefore felt to provide a training or workout tool for this sport in order to avoid accidents.

No equipment suitable for this purpose is known.

US 2011/143846 A1 describes a system for simulating and practicing water sports, such as wake boarding, wake surfing, wake skating, water skiing, kneeboarding and the like, comprising a motorized retractable rope provided with a handle. When a participant loses contact with the handle, the motorized retractable rope extends, unwinding from a winch, and is carried in the flow of water until it reaches a designated length, downstream of the facility, or until the participant regains the handle.

WO 2007/070915 A1 describes a sports board simulator, such as a surf board, skate board, snow board or kite board.

US 2005/017463 A1 describes a footboard to be used with an elastic trampoline for exercising and practicing aerial manoeuvres and recreational movements.

SUMMARY OF THE INVENTION

The aim of the present invention is to provide a hydrofoil simulator that is both realistic and, at the same time, safe for the user.

Within this aim, an object of the invention is to provide a simulator that can be advantageously used in different environments with a minimum of available space.

Another object of the invention is to provide a simulator advantageously usable in different environments and for different purposes such as kitesurfing, surfing, windsurfing and sailing schools, sports centres, video arcades, multiplex cinemas, cruise ships, large hotels, water parks, etc.

A further object of the invention is to provide a hydrofoil simulator that allows the sport to be practiced during any season, including winter.

Yet another object of the invention is to provide a hydrofoil simulator easily modifiable to be adapted to the simulation of the various disciplines that are practised with this type of board, such as, for example, kitesurfing, SUP, surfing, windsurfing, hydrofoil surfing, hydrofoil kiteboarding, etc.

A further object of the invention is to provide a hydrofoil simulator that is easily dismantlable and removable.

Yet another object of the invention is to provide a hydrofoil simulator that is also advantageous from the environmental impact standpoint.

A further object of the present invention is to provide a structure that can be produced using elements and materials commonly available on the market and which is also competitive from an economic standpoint.

The present structure, due to its peculiar implementation characteristics, is able to ensure the widest guarantees of reliability and safety in use.

These and other objects, which will be better highlighted in the following, are achieved by a hydrofoil simulator structure, comprising a tank, in which a water current is generated, and a frame which supports an elastic trampoline, positioned above the water surface of said tank; said structure also comprising a series of elastic ropes associated with a trapeze harness worn by a user, who stands on a board of a hydrofoil having wings immersed in said water; said structure being characterised in that said elastic trampoline has a hole to allow the hydrofoil mast to pass through.

BRIEF DESCRIPTION OF THE DRAWINGS

Further characteristics and advantages of the subject-matter of the present invention will become clearer through an examination of the description of a preferred, though not exclusive, embodiment of the invention, illustrated by way of non-limiting example in the attached drawings, wherein.

DETAILED DESCRIPTION OF THE PREFERRED EMBODIMENTS

Figure 1:
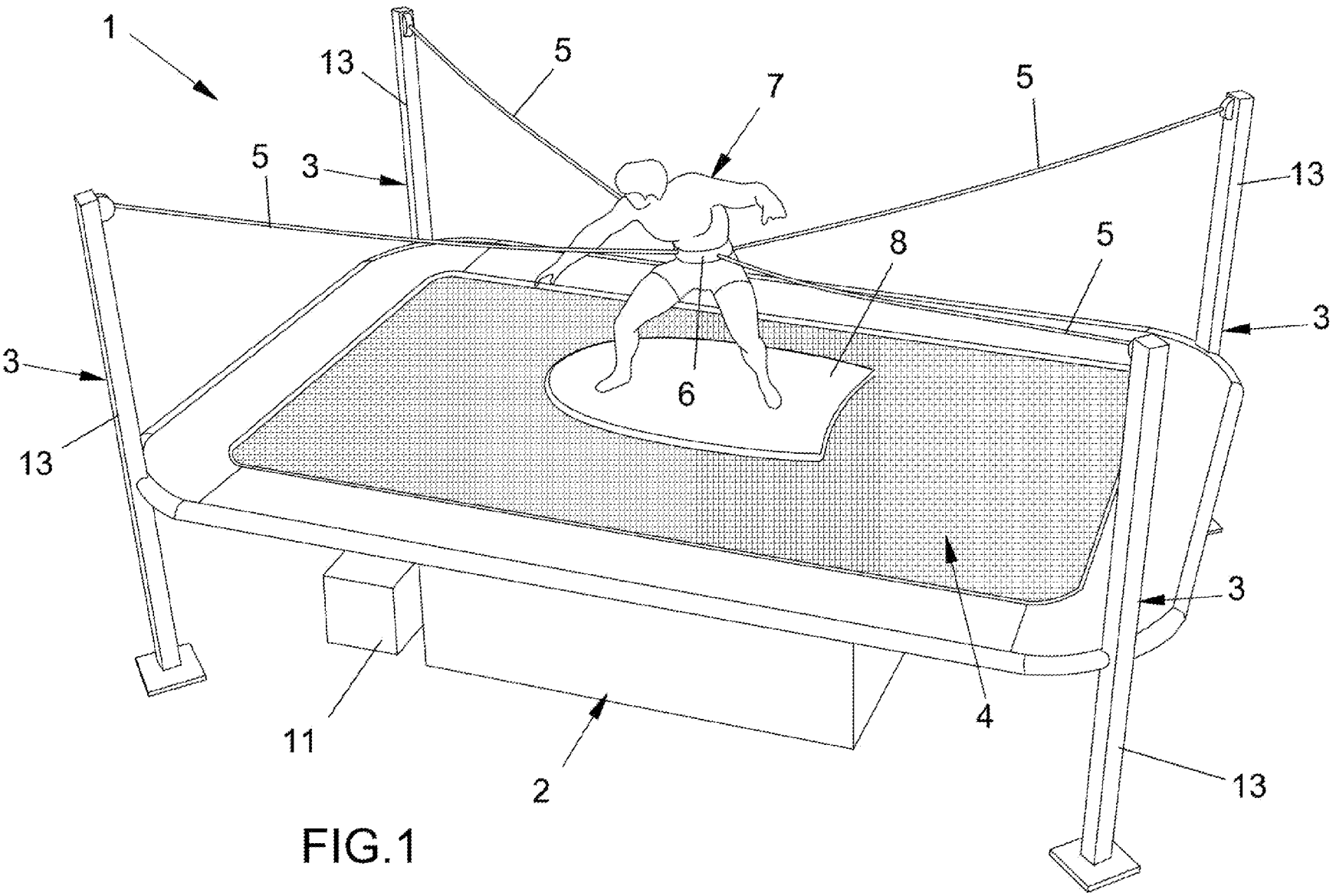
FIG. 1 is a perspective view of the hydrofoil simulator structure according to the present invention, illustrated in use.
Figure 2:
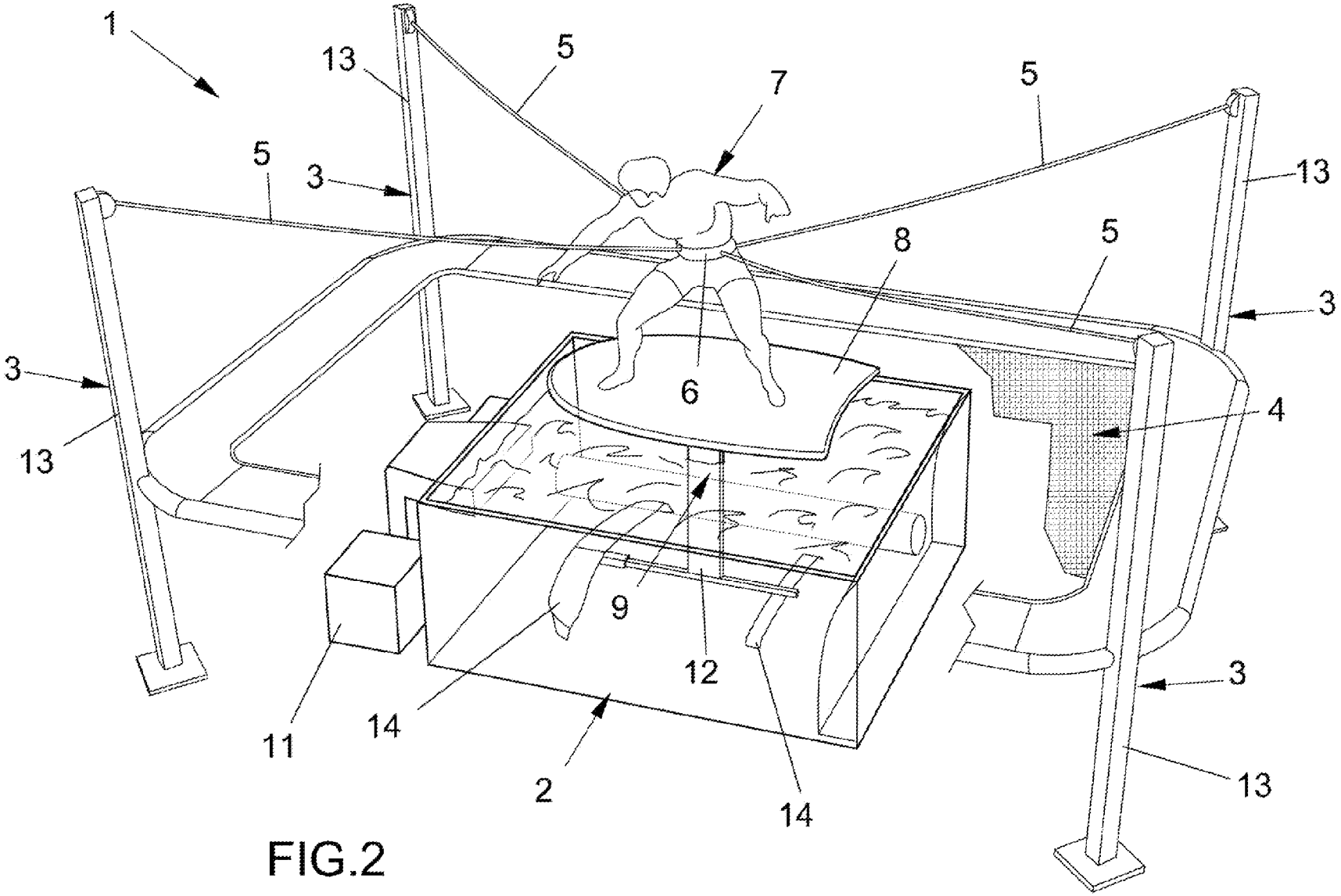
FIG. 2 is a partially sectional and cutaway view of the structure.
Figure 3:
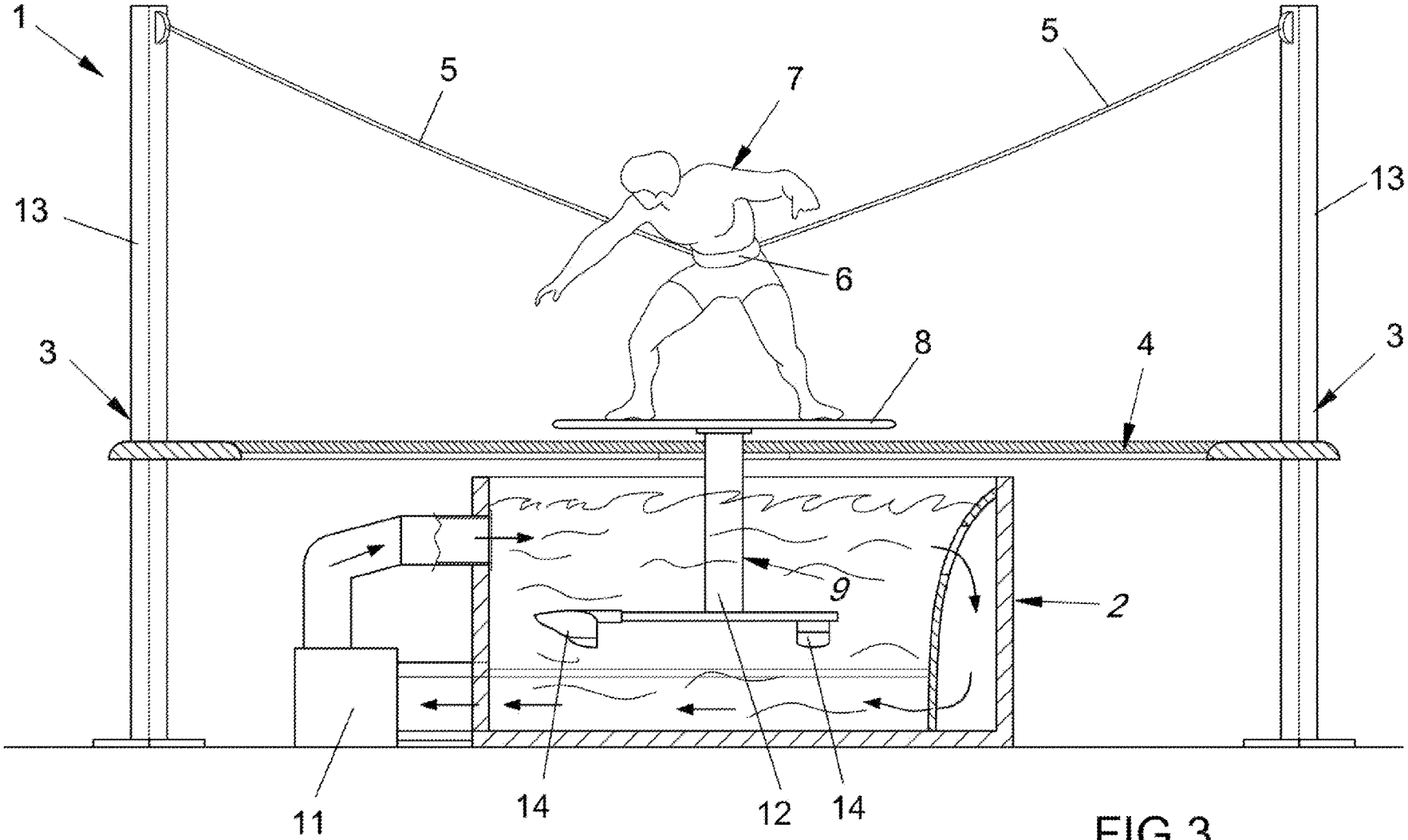
FIG. 3 is a partially sectional and cutaway side elevation view of the structure.
Figure 4:
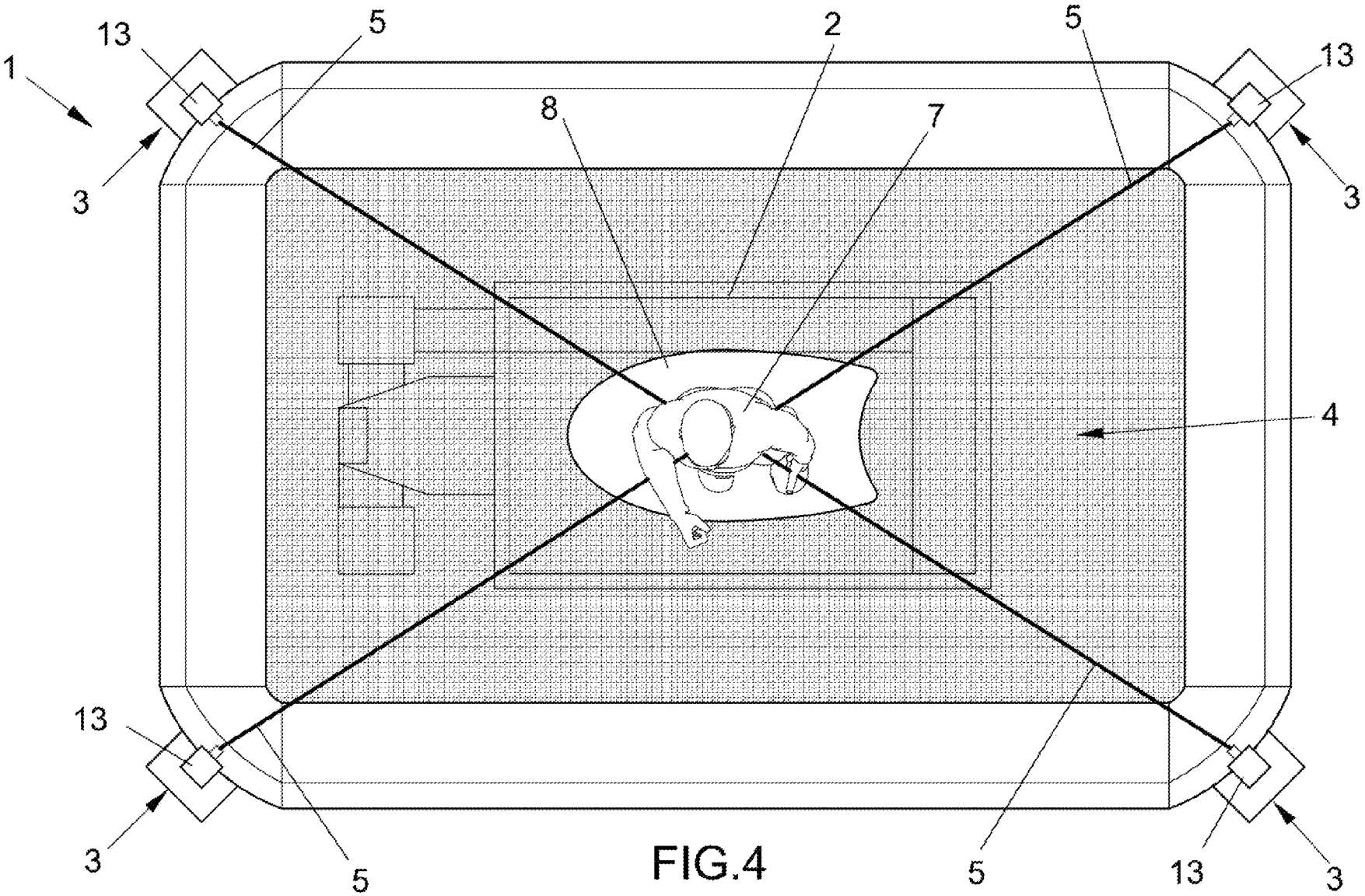
FIG. 4 is a plan view of the structure.
Figure 5:
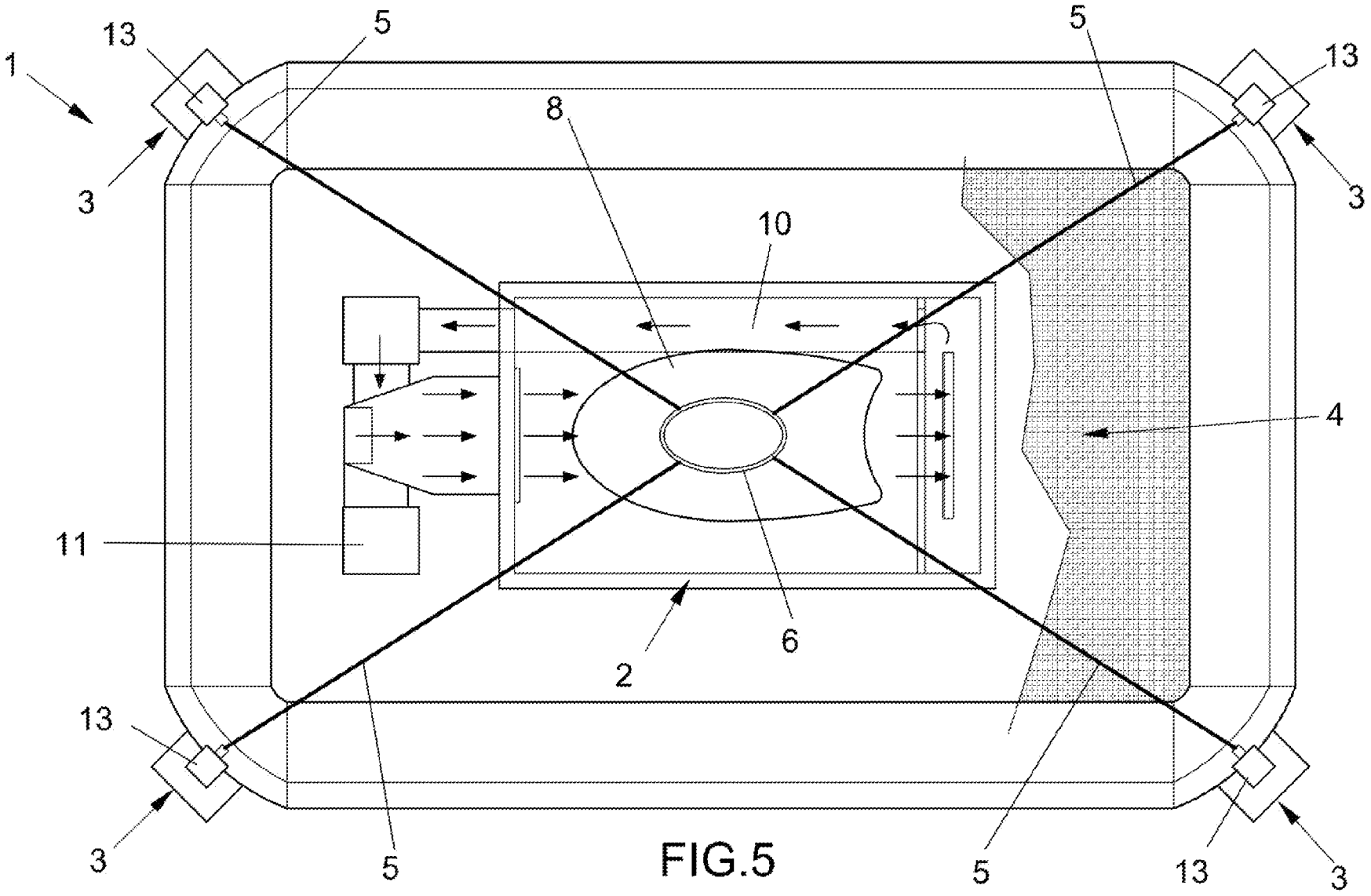
FIG. 5 is a partially sectional plan view of the structure.

With particular reference to the numerical symbols of the aforementioned figures, the hydrofoil simulator structure, according to the invention, indicated as a whole by the reference numeral 1, comprises a tank 2, in which a water current is generated, and a frame 3 which supports an elastic trampoline 4, positioned above the water surface of the tank 2.

The structure 1 also comprises a series of elastic ropes 5 associated with a trapeze harness 6 worn by a user 7 who is placed on a board 8 of a hydrofoil 9.

The tank 2 constitutes a so-called flow pool, i.e., a pool with a current, in essence a pool with walls containing a path for the water 10 to allow it to recirculate.

The system of the tank 2 comprises an electric motor 11 which drives a pump capable of generating a water current sufficient for allowing any hydrofoil discipline to be practiced.

The elastic trampoline 4 may advantageously be a normal rectangular-shaped elastic trampoline, associated with the frame 3 which comprises four supports, one for each corner, to which four bungees, i.e. the elastic ropes 5 supporting the user 7, are fastened.

The elastic trampoline 4 has a hole to allow the mast 12 of the hydrofoil 9 to pass through, so that the wings 14 of the hydrofoil remain below the water surface.

Each of the four bungees 5 has one end fastened to a respective angular upright 13 of the frame 3 and the opposite end attached to the user's trapeze harness.

These components are useful to allow a softer fall of the athlete in the case of overbalancing.

The trapeze harness 6 is advantageously a conventional kitesurfing or windsurfing trapeze.

Optionally, the structure comprises a photovoltaic panel and a battery to allow the simulator to be used wherever desired.

The hydrofoil can be a conventional hydrofoil, with the different attachments for the various disciplines.

Another optional element, not shown in the figures, is an inflatable board which softens the impacts for the user.

The inflatable board is particularly useful when practicing with children or more vulnerable people.

The simulator structure according to the present invention allows a user to practice a hydrofoil discipline in complete safety and with a high degree of realism.

In the simulator of the invention, the user is therefore on top of a board, which in turn is resting above the elastic trampoline provided with a hole. The latter allows the passage of the hydrofoil mast, connected on one end to the board and on the other end to the foil wing, all immersed in the water of the pool. When the water current is activated, the system consisting of the wing, mast and board rises and the athlete is suspended in the air, together with the board floating above the trampoline.

In the case of a loss of control, the user is supported during his/her fall by the four bungees, which cushion the fall.

Furthermore, the fall takes place on the elastic trampoline, which is furthermore protected at the edges by a net, not shown in the figures, without any possibility of the user being hit by the board or by the wings, which remain below the trampoline.

The characteristic of falling on top of the trampoline and not into the water makes the simulator structure adaptable to any environment, where there is room enough to assemble it, such as kitesurfing, surfing, windsurfing and sailing schools, sports centres, video arcades, multiplex cinemas, cruise ships, large hotels, water parks, etc.

Furthermore, the simulator structure according to the present invention can be used in all environmental conditions, including winter.

The present simulator structure allows all existing hydrofoil disciplines to be practiced simply by changing the wings, mast and board (optional).

The various disciplines that are practiced with this type of board are many, such as kitesurfing, SUP, surfing, windsurfing, etc.

The various disciplines can be simulated by varying only the dimension of the board and the wings, and by replacing the engine means, which in the case of kitesurfing is the kite and in the case of SUP is the paddling force, possibly combined with the current of the waves in the case of wave SUP.

According to the present invention, it is sufficient to simply vary the intensity of the current in order to switch, obviously also by changing the attachments, from practicing hydrofoil surfing to practicing hydrofoil kiteboarding.

The structure of the present invention can be used by anyone.

It is in fact an advantageous characteristic of the present simulator, due to its intrinsic safety, to allow children, even under the age of 10, to practice.

All hydrofoil disciplines are usually not recommended for children, as the wing is of considerable size and in the case of an impact with a child the damage could be significant.

The simulator structure of the present invention makes it possible for children, or people who are more insecure and are not ready to directly take action in the water, to experience this sensation of suspension in complete safety.

The simulator structure according to the present invention is environmentally friendly, as it is powered exclusively by electricity, which can be generated by a photovoltaic panel provided together with an appropriate battery or, in the case of the indoor version, by a conventional household power socket.

A further advantage of the present simulator structure is that it has no acoustic or environmental impact on the place where it is used.

Furthermore, the simulator structure according to the present invention is easily and quickly dismantlable and removable.

In essence, it has been found that the invention achieves the intended aim and objects.

Naturally, the materials used, as well as the dimensions, can be any according to requirements.

The invention claimed is:

1. A hydrofoil simulator structure, comprising a tank (2), in which a water current is generated, and a frame (3) which supports an elastic trampoline (4), positioned above a water surface of said tank (2); said structure also comprising a series of elastic ropes (5) associated with a trapeze harness (6) wearable by a user (7), who stands on a board (8) of a hydrofoil (9) having wings (14) immersed in water in said tank; said structure being characterized in that said elastic trampoline (4) has a hole to allow a mast (12) of the hydrofoil (9) to pass through.

2. The structure according to claim 1, characterized in that said tank (2) constitutes a flow pool, i.e. a pool with a water current (10), with recirculation.

3. The structure according to claim 2, characterized in that it comprises an electric motor (11) which drives a pump adapted to generate a water current.

4. The structure according to claim 3, characterized in that it comprises a photovoltaic panel and a battery adapted to power said electric motor (11).

5. The structure according to claim 1, characterized in that said elastic trampoline (4) is associated with the frame (3) that comprises supports (13) to which respective elastic ropes (5), capable of supporting the user (7), are fastened.

6. The structure according to claim 1, characterized in that it comprises four elastic ropes (5), each of which has one end fastened to a respective angular upright (13) of said frame (3) and the opposite end attached to said trapeze harness (6) wearable by said user (7).

7. The structure according to claim 1, characterized in that it comprises an inflatable board adapted to absorb impacts for the user.

8. The structure according to claim 1, characterized in that it comprises a peripheral protection net around elastic trampoline.

* * * * *